US010227882B2

(12) United States Patent
Tsypkaykin et al.

(10) Patent No.: US 10,227,882 B2
(45) Date of Patent: Mar. 12, 2019

(54) TURBINE BLADE, SET OF TURBINE BLADES, AND FIR TREE ROOT FOR A TURBINE BLADE

(71) Applicant: ANSALDO ENERGIA SWITZERLAND AG, Baden (CH)

(72) Inventors: Igor Tsypkaykin, Turgi (CH); Stefan Andreas Retzko, Zurich (CH); Marco Lamminger, Ennetbaden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 442 days.

(21) Appl. No.: 15/015,695

(22) Filed: Feb. 4, 2016

(65) Prior Publication Data

US 2016/0237833 A1 Aug. 18, 2016

(30) Foreign Application Priority Data

Feb. 18, 2015 (EP) ..... 15155592

(51) Int. Cl.
*F01D 5/18* (2006.01)
*F01D 5/30* (2006.01)
*F01D 5/08* (2006.01)

(52) U.S. Cl.
CPC ..... *F01D 5/3007* (2013.01); *F01D 5/081* (2013.01); *F01D 5/18* (2013.01); *F05D 2220/32* (2013.01);
(Continued)

(58) Field of Classification Search
CPC ..... F01D 5/3007; F01D 5/081; F01D 5/18; F01D 2220/32; F01D 2240/30; F01D 2260/20; F01D 2260/941
(Continued)

(56) References Cited

U.S. PATENT DOCUMENTS 3,574,482 A * 4/1971 Savage ..... F01D 5/18 416/90 R
3,706,508 A * 12/1972 Moskowitz ..... F01D 5/183 415/115
(Continued)

FOREIGN PATENT DOCUMENTS

EP 1 234 949 A2 8/2002

OTHER PUBLICATIONS

Search Report dated Sep. 17, 2015, by the European Patent Office for Application No. 15155592.7.

*Primary Examiner* — Jason D Shanske
*Assistant Examiner* — Brian Christopher Delrue
(74) *Attorney, Agent, or Firm* — Buchanan Ingersoll & Rooney PC

(57) ABSTRACT

A turbine blade having an airfoil and a fir tree root is disclosed. The fir tree root has a lengthwise direction, a crosswise direction extending between two lateral sides of the fir tree root, and a span direction extending from a root base towards an airfoil tip. The fir tree root includes a web interposed between each pair of at least two neighboring channels. For each web, a web-to-channel ratio with each of the two neighboring channels is chosen to be larger than or equal to 0.5 and is smaller than or equal to 0.85 at least at a position where the root width is a minimum load bearing root width in a load bearing section of the fir tree root. In another aspect, overall web-to-channel ratio is defined as a ratio between the sum of all web lengths and the sum of all channel lengths.

14 Claims, 2 Drawing Sheets

(52) U.S. Cl.
CPC ..... *F05D 2240/30* (2013.01); *F05D 2260/20* (2013.01); *F05D 2260/941* (2013.01)

(58) Field of Classification Search
USPC ..... 416/219 R
See application file for complete search history.

(56) References Cited

U.S. PATENT DOCUMENTS 4,073,599 A * 2/1978 Allen ..... F01D 5/187 416/232
4,236,870 A * 12/1980 Hucul, Jr. ..... F01D 5/187 415/115
4,583,914 A * 4/1986 Craig ..... F01D 5/147 416/204 A
4,604,031 A * 8/1986 Moss ..... F01D 5/187 415/115
4,650,399 A * 3/1987 Craig ..... B23P 15/04 416/193 A
5,536,143 A * 7/1996 Jacala ..... F01D 5/187 416/96 R
5,928,725 A * 7/1999 Howard ..... C23C 16/045 427/237
5,967,752 A * 10/1999 Lee ..... F01D 5/187 416/97 R
6,079,946 A * 6/2000 Suenaga ..... F01D 5/187 415/114
6,227,804 B1 * 5/2001 Koga ..... F01D 5/187 415/115
6,474,946 B2 * 11/2002 Kildea ..... F01D 5/081 416/241 B
6,485,262 B1 * 11/2002 Heyward ..... C23C 10/06 416/241 R
6,491,496 B2 * 12/2002 Starkweather ..... F01D 5/187 415/115
6,634,858 B2 * 10/2003 Roeloffs ..... F01D 5/186 29/889.721
6,923,616 B2 * 8/2005 McRae, Jr. ..... F01D 5/187 415/115
6,932,570 B2 * 8/2005 Heyward ..... F01D 5/081 416/241 R
6,974,308 B2 * 12/2005 Halfmann ..... B22C 9/04 415/115
7,131,817 B2 * 11/2006 Keith ..... F01D 5/081 416/97 R
7,223,072 B2 * 5/2007 Riahi ..... F01D 5/186 29/557
8,591,189 B2 * 11/2013 Correia ..... F01D 5/187 416/96 R
8,622,702 B1 * 1/2014 Liang ..... F01D 5/18 416/96 R
8,647,064 B2 * 2/2014 Boyer ..... F01D 5/187 416/193 A
8,764,394 B2 * 7/2014 Lee ..... F01D 5/187 416/97 R
8,888,455 B2 * 11/2014 Seneff ..... F01D 5/081 416/248
9,051,838 B2 * 6/2015 Wardle ..... F01D 5/081
9,657,579 B2 * 5/2017 Botrel ..... F01D 5/081
9,803,500 B2 * 10/2017 Propheter-Hinckley ..... F01D 25/12
9,850,761 B2 * 12/2017 Thomen ..... F01D 5/186
2002/0119046 A1 * 8/2002 Kildea ..... F01D 5/081 416/97 R
2003/0156943 A1 8/2003 Strassberger et al.
2005/0265841 A1 * 12/2005 Magowan ..... F01D 5/081 416/97 R
2007/0189898 A1 * 8/2007 Hooper ..... F01D 5/187 416/97 R
2012/0087782 A1 * 4/2012 Valiente ..... F01D 5/081 415/178

* cited by examiner

TURBINE BLADE, SET OF TURBINE BLADES, AND FIR TREE ROOT FOR A TURBINE BLADE

TECHNICAL FIELD

The present disclosure relates to a turbine blade, a set of turbine blades, a fir tree root and a set of fir tree roots.

BACKGROUND OF THE DISCLOSURE

It is known to attach turbine blades to a rotor shaft by means of fir tree blade roots. Such blade roots comprise, starting from a root base, a number of alternating ridges and grooves. Said roots are slidingly received in counterpart slots within the shaft. When loaded e.g. through centrifugal forces, the roots bear on upward pointing, that is, pointing towards the airfoil, bearing surfaces of the ridges.

The airfoils of blades are typically arranged in a center region of the blade in a lengthwise direction of the blade foot. Thus, the centrifugal load of the airfoil acts more fiercely in said center region and consequently resulting in bending strains bending the foot along its lengthwise direction. Differential thermal expansion between the airfoil and the blade root further contributes to said bending.

Typically, blades in gas turbines are cooled. A coolant flow is introduced into hollow blade airfoils through openings and channels in the blade roots at a lengthwise position of the airfoil. However, due to the presence of these channels the elastic deformation of a blade root upon loading is further enlarged in the region where the channels are arranged. That is, in the region where a bending displacement is induced, the bearing surfaces are more firmly pressed against their counterparts in the shaft. This results in enhanced stresses locally induced in the blade roots as well as in the counterpart features of the shaft in the region of the coolant channels. In turn, early fatigue may occur and parts may be needed to be replaced more frequently.

One possibility known in the art to account for this problem is to cool the shaft in the attachment areas to improve mechanical properties of the material. However, this consumes cooling air, which reduces efficiency and power, and may not be readily possible due to other constraints, like space, complexity, cost and lifetime.

SUMMARY OF THE DISCLOSURE

It is an object of the present disclosure to provide a blade-shaft interface which reduces stresses in the blade roots as well as in the shaft attachment area.

It is a further object of the present disclosure to provide a blade-shaft interface which distributes the load more evenly on the load bearing members.

It is a more specific object of the present disclosure to provide a blade-shaft interface which improves the situation described above, and enhances component lifetime.

These objects, among other effects, which may become readily apparent to the skilled person in view of the description below, are achieved in providing a multitude of webs interposed between channels in the blade root in order to stiffen the blade root, and dimensioning said webs such as to maintain a web to channel ratio, which is defined as the lengthwise extension of one or more webs related to the lengthwise extension of one or more channels, within a well-defined specific range, which on the one hand provides a sufficient stiffening effect and on the other hand provides sufficient channel cross sections to provide the required amount of coolant to an airfoil, said conditions being fulfilled at least at a position where the root width is a minimum load bearing root width in a load bearing section of the fir tree root. It should be noted, although it will be readily apparent to the skilled person, that a width in the context of the present application means an extent in a crosswise direction which in turn will be lined out below. Also, the lengthwise extension, while the meaning will likewise be readily apparent, will be defined in more detail below. As mentioned above, a fir tree root bears a load which is e.g. induced by centrifugal forces during operation of the engine on bearing surfaces of the alternatingly arranged ridges and grooves which point towards the airfoil. It is thus understood, that the load bearing section of the fir tree root starts, as seen from the root base, beyond the first ridge. As will be appreciated, these ridges, and in particular the surfaces pointing towards the airfoil, or top surfaces, provide the actual load bearing attachment features of the fir tree root. In other words, a section of the root which is arranged between the root base and said first or bottom ridge is essentially free of stresses and thus need not be an object of the considerations of this disclosure. On the other hand, the portion of the root arranged between the first or bottom ridge and the airfoil represents a load bearing section of the root, where the features described herein come into play.

Turbine blades fulfilling said requirements are described in claims 1 and 7.

A turbine blade according to the present disclosure comprises an airfoil and a fir tree root. The fir tree root has a lengthwise direction, a crosswise direction extending between two lateral sides of the fir tree root, and a span direction extending from a root base towards an airfoil tip. The fir tree root comprises at least one longitudinal groove arranged on each lateral side, said longitudinal groove extending along and defining the lengthwise direction. It should be noted, that the fir tree root may be bent or curved along the lengthwise direction when seen in the span direction. That is to say, the lengthwise direction may extend along a curved line when seen along the span direction. However, of course, the fir tree root may also extend straight and consequently the lengthwise direction in this case extends along a straight line. The fir tree root exhibits a root width, or crosswise extent, measured between the two lateral sides, said width, due to an alternating arrangement of ridges and grooves as described in the introduction to this disclosure, varying along the span direction. The fir tree root, according to the present disclosure, comprises at least two internal channels extending in the span direction and in particular being open at the base of the blade root and being in fluid communication with cooling channels provided inside the airfoil for providing a coolant to the airfoil. Each of said channels exhibits a channel length measured along the lengthwise direction. The root further comprises a web interposed between each pair of neighboring channels, each of said at least one webs having a web length measured along the lengthwise direction. In a first aspect of the present disclosure a local web-to-channel ratio between a web length and the channel length of each of the two neighboring channels for each of the webs interposed between channels is larger than or equal to 0.5 and is smaller than or equal to 0.85 at least at a position where the root width is a minimum load bearing root width in a load bearing section of the fir tree root. In other words, for each web the lengthwise extent of any neighboring channel does not exceed the lengthwise extent of the web by more than 100%, thus restricting the lever along which the elastic deformation becomes effective and thus reducing a maximum overall deformation of the root and consequently of the attachment features. In another aspect, an overall web-to-channel ratio, defined as a ratio between the sum of all web lengths and the sum of all channel lengths, is larger than or equal to 0.3 and is smaller than or equal to 0.6 at least at a position where the root width is a minimum load bearing root width in a load bearing section of the fir tree root. It is understood that the conditions may be fulfilled for the local web-to-channel ratios, in particular for each web, as well as for the overall web-to-channel ratio in one and the same embodiment.

In still another aspect of the present disclosure, a ratio between each channel length and the minimum load bearing root width or crosswise extent may be larger than or equal to 1.0 and smaller than or equal to 1.4. A ratio between the minimum load bearing root width or crosswise extent and the channel width or crosswise extent may be larger than or equal to 3.0, in order to maintain a minimum wall thickness, which accounts not only for mechanical integrity, but also for manufacturing tolerances.

It should be understood that the technical effect of arranging the webs, featuring a certain well-defined web-to-channel ratio, is not in first instance adding mechanical strength in enhancing the total material cross section. This, as is apparent, would have been achieved in a straight forward approach in providing one single channel with an equivalent cross section to that of the at least two channels provided to the present disclosure. The material would then simply have been added at lengthwise end sections of the fir tree root. In fact, the channels need to provide a certain cross section, and thus simply adding material may not be possible, or possible only to a very limited extent. In this case the root would be stiff at the longitudinal ends, while little material would be provided in the lengthwise center of the root. In turn, the strain per unit material upon loading is high in this lengthwise center section of the root, resulting in accordingly high elastic deformations along a large lever. As is appreciated, regions of the fir tree root in the deformed area get into more intense contact with the counterpart features provided on the shaft. In interaction with the counterpart bearing surfaces provided on the shaft, this results in an uneven load distribution along the fir tree root attachment features which would mainly bear in the deformed region, inducing peak stresses, and consequently further concentrate stresses in the root region where little material is provided. It would also locally enhance stresses in the shaft counterpart attachment features. Thus, the blade root as well as the shaft could become subject to early fatigue. In contrast, it is an important aspect of the present disclosure to provide a multitude of at least two channels with webs disposed between them. That is, material is provided in a center region of the fir tree root in a lengthwise direction and thereby stiffening the fir tree root. The deformation due to loading becomes effective along a shorter lever, thus the total deformation is reduced, and the load is more evenly distributed along the bearing attachment features, resulting in avoiding or at least significantly reducing peak stresses. Component lifetime is thus significantly enhanced, although the overall material cross section remains constant compared to the straight forward approach lined out above.

It will be understood that the range specified for the web-to-channel ratio is not arbitrarily chosen, but is chosen such that on the one hand the stiffness is considerably enhanced while providing sufficiently large cross sections for the coolant flow.

The range of local web-to-channel ratios may in certain embodiments be chosen to be larger than or equal to 0.53 and smaller than or equal to 0.85. In more specific embodiments, the local web-to-channel ratio may be larger than or equal to 0.55. In other more specific embodiments the local web-to-channel ratio may be chosen to be smaller than or equal to 0.8. In still more specific embodiments, the local web-to-channel ratio may be larger than or equal to 0.55 and smaller than or equal to 0.8. The range of overall web-to-channel ratios may in certain embodiments be chosen to be larger than or equal to 0.35 and smaller than or equal to 0.6. In more specific embodiments, the overall web-to-channel ratio may be larger than or equal to 0.4. In other more specific embodiments the overall web-to-channel ratio may be chosen to be smaller than or equal to 0.55. In still more specific embodiments, the overall web-to-channel ratio may be larger than or equal to 0.4 and smaller than or equal to 0.55. These further restricted ranges may be applied to all further aspects and embodiments of the blade according to the present disclosure described below.

Due to the alternating arrangement of ridges and grooves, groove bases may be present at one or more positions along the span direction of the root. It is understood that the load bearing root width may become minimum at a specific span direction position of a groove base. Accordingly, in a further aspect of the present disclosure, the overall web-to-channel ratio is larger than or equal to 0.3 and smaller than or equal to 0.6 at least at a span direction position of a groove base. In still a further aspect of the present disclosure, for each web a local web-to-channel ratio between the web length and the channel length of each of the two neighboring channels may be larger than or equal to 0.5 and smaller than or equal to 0.85 at least at a span direction position of a groove base.

In further embodiments of the turbine blade according to the present disclosure, the root may comprise at least two grooves arranged on each lateral side. A bottom groove on each side may then be defined as the groove being closest to the root base. In an aspect of the present disclosure, the overall web-to-channel ratio is larger than or equal to 0.3 and smaller than or equal to 0.6 at least at a span direction position of one of the bottom groove bases. Likewise, for each web a local web-to-channel ratio between the web length and the channel length of each of the two neighboring channels may be larger than or equal to 0.5 and smaller than or equal to 0.85 at least at a span direction position of one of the bottom groove bases.

Further, in more specific embodiments of a turbine blade according to the present disclosure, the overall web-to-channel ratio is larger than or equal to 0.5 and smaller than or equal to 0.85 at a span direction position of each of the groove bases, and/or for each web a ratio between the web length and the channel length of each of the two neighboring channels is larger than or equal to 0.5 and smaller than or equal to 0.85 at a span direction position of each of the groove bases.

In further even more specific embodiments of the turbine blade according to the present disclosure, the overall web-to-channel ratio may be larger than or equal to 0.3 and smaller than or equal to 0.6 at least essentially along the entire channel extent within the root, or within the entire load bearing section of the root, respectively, and/or for each web a local web-to-channel ratio between the web length and the channel length of each of the two neighboring channels may be larger than or equal to 0.5 and smaller than or equal to 0.85 at least essentially along the entire channel extent within the root, or within the entire load bearing section of the root, respectively.

As lined out above, the load bearing section of the root is arranged beyond the first fir tree root ridge as seen from the root base, or bottom ridge. Consequently, either a region between the bottom ridge and the root base is not load bearing, and/or a minimum load bearing root width is arranged at a span direction position beyond the bottom ridge seen from the root base. In any case, the minimum load bearing root width is at a certain distance from the root base in the span direction. The channels may thus feature inlet fan sections at the base, said inlet fan sections being larger in cross section than a duct section of the channels, and smoothly transitioning into the duct section cross section. This may serve, on the one hand, to achieve a smoother inflow of coolant into the channels, and on the other hand to make up for tolerances and thermally caused displacement of the blade root in the rotor shaft at the interface between the rotor shaft coolant ducts and the channels provided in the root. Accordingly, in one aspect of the present disclosure, a turbine blade may be characterized in that at least one of the channels comprises an inlet fan section at the root base, and a duct section, wherein the overall web-to-channel ratio is larger than or equal to 0.3 and smaller than or equal to 0.6 at least essentially along the entire duct section extent within the root, or within the load bearing section of the root, respectively. In still another aspect, a turbine blade according to the present disclosure may be characterized in that at least one of the channels comprises an inlet fan section at the root base and a duct section, wherein for each web a ratio between the web length and the channel length of each of the two neighboring channels is larger than or equal to 0.5 and smaller than or equal to 0.85 at least essentially along the entire duct section extent within the root, or within the load bearing section of the root, respectively.

A turbine usually comprises multiple turbine stages with blades of different airfoil lengths, wherein the length of the airfoils increases from one turbine stage to a subsequent turbine stage along a path along which a compressed working fluid is expanded. While in the first turbine stage more cooling is required due to the higher working fluid temperature, in a subsequent turbine stage the working fluid has a lower temperature, but the longer airfoil may be heavier and thus the mechanical loading on the blade root is increased compared to a blade in a previous turbine stage. Disclosed is thus a set of turbine blades as described above, wherein said set comprises at least two blades comprising airfoils of different airfoil lengths, and wherein at least one of the overall web-to-channel ratio and/or a ratio between a web length and the length of the neighboring channels is larger for a blade with a larger airfoil length than for a blade with a smaller airfoil length. That is, the root of a blade of shorter airfoil length, which is intended for use in a turbine stage with a comparatively higher working fluid temperature, is provided with comparatively larger coolant channels, thus providing a comparatively higher coolant flow. The root of a blade of longer airfoil length, intended for use in a turbine stage with a comparatively lower working fluid temperature, is provided with comparatively smaller coolant channels and larger webs, thus providing an increases stiffness in order to bear the higher mechanical load.

Further disclosed is a fir tree root for a blade as described above, featuring a multitude of coolant channels with interposed webs, wherein an overall web-to-channel ratio and/or for each web a ratio between the web length and the channel length of each of the two neighboring channels is within one of the above specified ranges at least at one of the above specified locations in the span direction.

Still further disclosed is a set of fir tree roots for a set of blades as described above, wherein at least one of the overall web-to-channel ratio and/or for each web a ratio between the web length and the channel length of each of the two neighboring channels varies in dependence on the intended airfoil length.

It is understood, that the different embodiments described above, or features thereof, respectively, may be combined with each other. Further variants and embodiments of the invention disclosed herein may become readily apparent to the skilled person in view of the description above and the illustration of embodiments below.

BRIEF DESCRIPTION OF THE DRAWINGS

The subject matter of the present disclosure is now to be explained in more detail by means of selected exemplary embodiments shown in the accompanying drawings. The figures show FIG. 1 a blade comprising an airfoil and a fir tree root.

It is understood that the drawings are highly schematic, and details not required for instruction may have been omitted for the ease of understanding and depiction. It is further understood that the drawings show only selected, illustrative embodiments, and embodiments not shown may still be well within the scope of the herein claimed subject matter.

EXEMPLARY MODES OF CARRYING OUT THE TEACHING OF THE PRESENT DISCLOSURE

Figure 2:
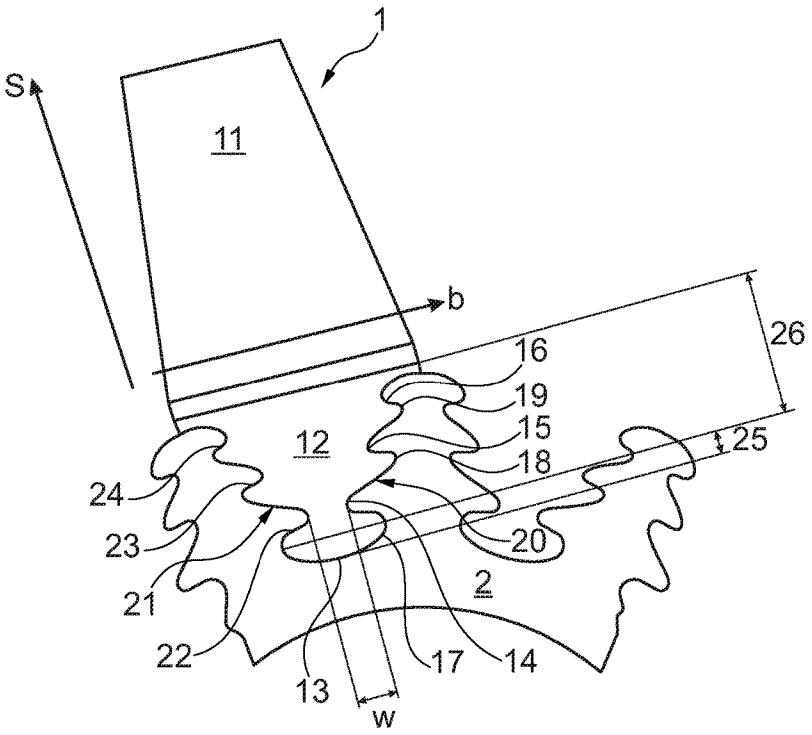
FIG. 2 a different perspective of a blade comprising a fir tree root received in a rotor shaft.
Figure 1:
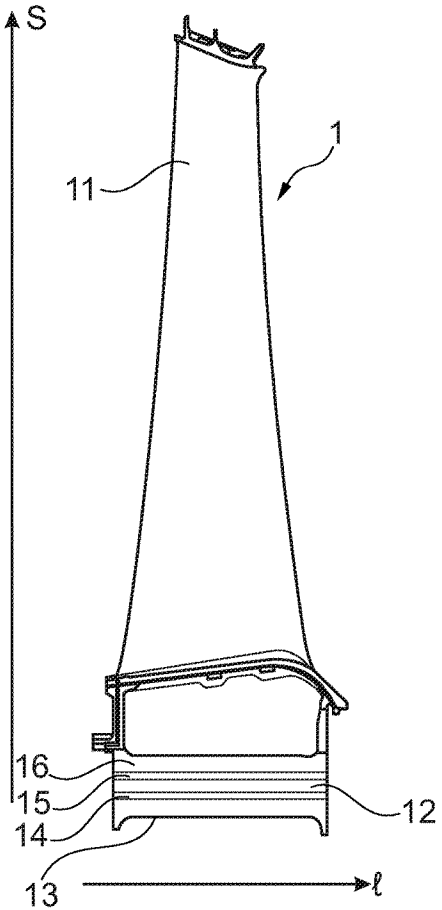

FIG. 1 depicts an exemplary embodiment of a turbine blade 1 comprising an airfoil 11 and a fir tree root 12. The blade and the root extend along a lengthwise direction l and a span direction s. The crosswise direction b is not visible in this view and is shown in FIG. 2. The fir tree root 12 comprises a base 13. Further, grooves with groove bases 14, 15 and 16 are arranged on a lateral side of the foot and extent along the lengthwise direction.

FIG. 2 shows a schematic view of a blade 1 with the fir tree root 12 received in the rotor shaft 2, in a view direction along the lengthwise direction. In this view, the blade 1 extends along a span direction s and the crosswise direction b. As becomes apparent, the fir tree root 12 comprises lateral sides 20 and 21. On each of the lateral sides, grooves with groove bases 14, 15 and 16 and ridges 17, 18 and 19 are alternatingly arranged. The blade root is slidingly received in a counterpart slot in the rotor shaft. Upon operation, centrifugal forces act along the span direction s, from the blade root to the blade tip. The load is borne by bearing surfaces 22, 23 and 24. As becomes apparent, a section 25 of the root below a first ridge, or, in other words, between the first or bottom ridge 17 and the base 13 is not load bearing, whereas a section 26 of the blade root is load bearing. Root width w is measured between lateral sides 20, 21 along the crosswise direction, and varies along the span direction due to the alternating arrangement of ridges and grooves. A minimum load bearing root width is, in this embodiment, located at a lower or bottom groove base 14, that is, the groove base closest to the root base 13. As is apparent, the strain on the material will be high at this minimum load bearing root width. Further critical cross-sections may be located at the position of groove bases 15 and 16. Stresses at the groove bases may further be enhanced due to notch effects.

Thermally highly loaded turbine blades, such as for instance turbine blades of gas turbines, are often, or in fact mostly, provided with internal coolant ducts and features. Coolant channels may then be provided in the blade root in order to allow a supply of coolant from the shaft to the airfoil. It is apparent, that the presence of coolant channels in the blade root weakens the structure. These coolant channels are usually provided in a lengthwise center section of the blade root. Thus, the blade root becomes mechanically softer in the middle section, and, upon loading, tends to bend or buckle along the lengthwise direction. Due to this elastic deformation of the blade root, load gets unevenly distributed along the lengthwise extent of the bearing surfaces 22, 23 and 24, as well as along the counterpart bearing surfaces provided on the shaft.

Figure 3:
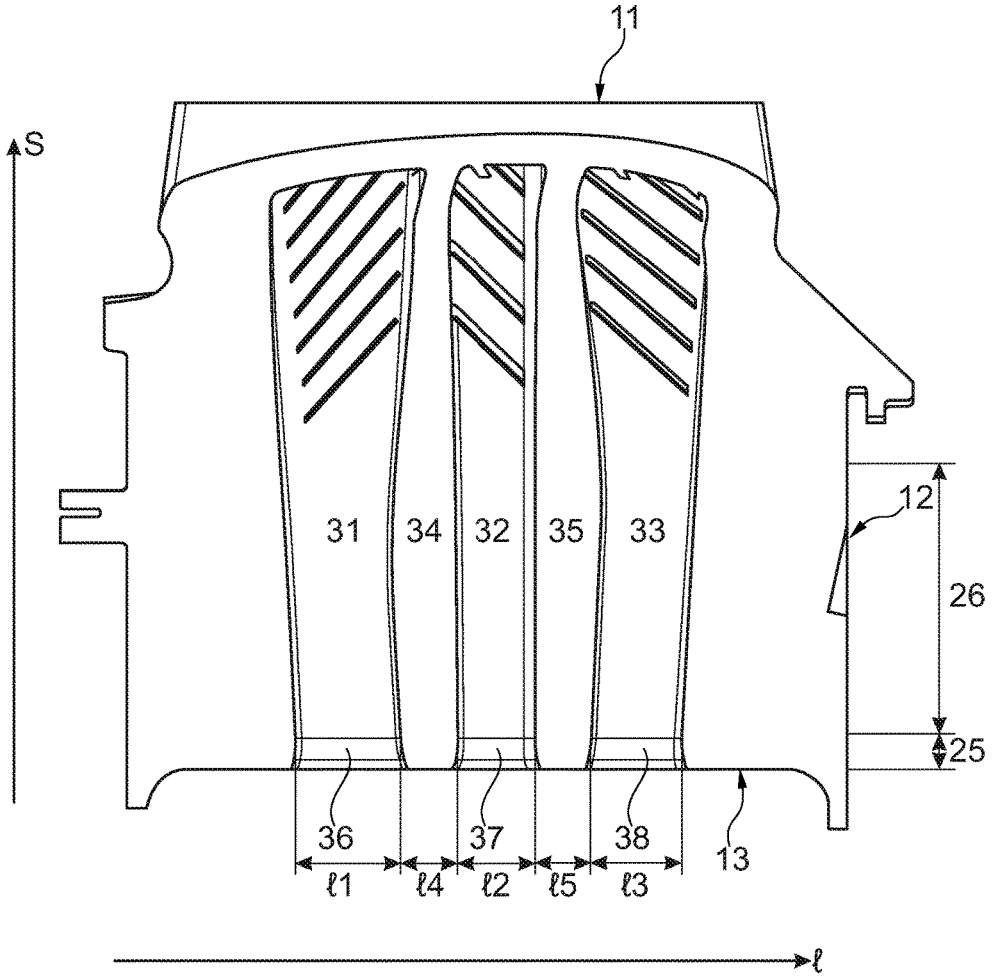
FIG. 3 a section of an exemplary embodiment of a fir tree root of a blade according to the present disclosure.

The present disclosure thus proposes not to provide a single coolant channel in the blade root, but a multitude of coolant channels with interposed webs, stiffening the lengthwise center section of the blade root. This is shown in the sectional view in FIG. 3. Blade root 12 is provided with, in this exemplary embodiment, three coolant channels 31, 32 and 33. Webs 34 and 35 are interposed between the coolant channels. Coolant channels 31, 32, and 33 serve to provide coolant to internal cooling features provided in airfoil 11. Coolant channels 31, 32 and 33 are provided with inlet fan sections 36, 37 and 38 arranged at the base 13. Said inlet fan sections are provided in a non-load bearing section 25 of the blade root 12, and smoothly merge into duct sections of the coolant channels extending in the span direction and leading towards the airfoil 11. First channel 31 duct section has a lengthwise extent l1, defining the channel length. Second channel 32 duct section has a lengthwise extent l2, defining the respective channel length. Third channel 33 duct section has a lengthwise extend l3, defining the respective channel length. First web 34 has lengthwise extend l4, defining the respective web length. Second web 35 has lengthwise extend l5, defining the respective web length. Due to the presence of the webs, a lever along which bending strains become effective is considerably reduced as compared to one single channel of a comparable cross section, and the blade root is stiffened against bending due to centrifugal loads during operation.

It has been found beneficial to maintain an overall web-to-channel ratio as defined, in this exemplary embodiment, by (l4+l5)/(l1+l2+l3) within a certain range. Said ratio, according to the present disclosure, is chosen to be larger than or equal to 0.3 and smaller than or equal to 0.6. In a further embodiment the range of overall web-to-channel ratios may be chosen to be larger than or equal to 0.35 and smaller than or equal to 0.6. In more specific embodiments, the overall web-to-channel ratio may be larger than or equal to 0.4. In other more specific embodiments the overall web-to-channel ratio may be chosen to be smaller than or equal to 0.55. In still more specific embodiments, the overall web-to-channel ratio may be larger than or equal to 0.4 and smaller than or equal to 0.55. These conditions need not be fulfilled at the inlet fan sections, as those are arranged in a non-load bearing section of the root. However, these conditions are, according to the present disclosure, fulfilled in the duct sections of the channels, at least at a position where the root width, measured between two lateral sides in the crosswise direction, is a minimum load bearing root width. In a further aspect of the disclosure, for each of the webs 34 and 35 the ratio between the web length and the length of each neighboring channel is chosen to be larger than or equal to 0.5 and smaller than or equal to 0.85. Further, said ratio may be chosen larger than or equal to 0.53 and smaller than or equal to 0.85. In more specific embodiments, the local web-to-channel ratio may be larger than or equal to 0.55.

In other more specific embodiments the local web-to-channel ratio may be chosen to be smaller than or equal to 0.8. In still more specific embodiments, the local web-to-channel ratio may be larger than or equal to 0.55 and smaller than or equal to 0.8. That is, each of the ratios l4/l1, l4/l2, l5/l2 and l5/l3 is chosen to be in one of the specified ranges.

Moreover, a ratio between each channel length l1, l2 and l3 and the minimum load bearing root width or crosswise extent, depicted at w in FIG. 2, may be larger than or equal to 1.0 and smaller than or equal to 1.4. A ratio between the minimum load bearing root width or crosswise extent w and a channel width or crosswise extent for each channel may be larger than or equal to 3.0, in order to maintain a minimum wall thickness, which accounts not only for mechanical integrity, but also for manufacturing tolerances.

While the subject matter of the disclosure has been explained by means of exemplary embodiments it is understood that these are in no way intended to limit the scope of the claimed subject matter. It will be appreciated that the claims cover embodiments not explicitly shown or disclosed herein, and embodiments deviating from those disclosed in the exemplary modes of carrying out the teaching of the present disclosure will still be covered by the claims.

LIST OF REFERENCE NUMERALS

1 blade
2 rotor shaft
11 airfoil
12 fir tree root
13 root base
14 groove base
15 groove base
16 groove base
17 ridge
18 ridge
19 ridge
20 lateral side
21 lateral side
22 bearing surface
23 bearing surface
24 bearing surface
25 non-load bearing section
26 load bearing section
31 coolant channel
32 coolant channel
33 coolant channel
34 web
35 web
36 inlet fan section
37 inlet fan section
38 inlet fan section
l1 channel length
l2 channel length
l3 channel length
l4 web length
l5 web length
b crosswise direction
l lengthwise direction
s span direction
w root width

The invention claimed is:

1. A turbine blade comprising:

an airfoil and a fir tree root, the fir tree root having a lengthwise direction, a crosswise direction extending between two lateral sides of the fir tree root, and a span direction extending from a root base towards an airfoil tip, the fir tree root having at least one longitudinal groove arranged on each lateral side and extending along and defining the lengthwise direction, the fir tree root having a root width (w) measured between the two lateral sides, said root width (w) varying along the span direction, the fir tree root having at least two channels extending in the span direction, each of said channels having a channel length measured along the lengthwise direction, the root having a web interposed between each pair of neighboring channels, each web having a web length measured along the lengthwise direction, wherein for each web a local web-to-channel ratio between the web length and the channel length of each of the two neighboring channels is larger than or equal to 0.5 and is smaller than or equal to 0.85 at least at a position where the root width (w) is a minimum load bearing root width in a load bearing section of the fir tree root.

2. The turbine blade according to claim 1, wherein for each web a local web-to-channel ratio between the web length and the channel length of each of the two neighboring channels is larger than or equal to 0.5 and smaller than or equal to 0.85 at least at a span direction position of a groove base.

3. The turbine blade according to claim 1, the root comprising:

at least two grooves arranged on each lateral side, a bottom groove on each side being closest to the root base, wherein for each web a local web-to-channel ratio between the web length and the channel length of each of the two neighboring channels is larger than or equal to 0.5 and smaller than or equal to 0.85 at least at a span direction position of one of the bottom groove bases.

4. The turbine blade according to claim 1, wherein for each web a local web-to-channel ratio between the web length and the channel length of each of the two neighboring channels is larger than or equal to 0.5 and smaller than or equal to 0.85 at a span direction position of each of the groove bases.

5. The turbine blade according to claim 1, wherein for each web a local web-to-channel ratio between the web length and the channel length of each of the two neighboring channels is larger than or equal to 0.5 and smaller than or equal to 0.85 at least essentially along an entire channel extent within the root or within the load bearing section of the root, respectively.

6. The turbine blade according to claim 1, wherein at least one of the channels comprises:

an inlet fan section at the root base and a duct section, wherein for each web a local web-to-channel ratio between the web length and the channel length of each of the two neighboring channels is larger than or equal to 0.5 and smaller than or equal to 0.85 at least essentially along an entire duct extend within the root or within the load bearing section of the root, respectively.

7. A turbine blade comprising:

an airfoil and a fir tree root, the fir tree root having a lengthwise direction, a crosswise direction extending between two lateral sides of the fir tree root, and a span direction extending from a root base towards an airfoil tip, the fir tree root having at least one longitudinal groove arranged on each lateral side and extending along and defining the lengthwise direction, the fir tree root having a root width (w) measured between the two lateral sides, said root width (w) varying along the span direction, the fir tree root having at least two channels extending in the span direction, each of said channels having a channel length measured along the lengthwise direction, the root having a web interposed between each pair of neighboring channels, each web having a web length measured along the lengthwise direction, wherein an overall web-to-channel ratio defined as a ratio between a sum of all web lengths and a sum of all channel lengths is larger than or equal to 0.3 and is smaller than or equal to 0.6 at least at a position where the root width (w) is a minimum load bearing root width in a load bearing section of the fir tree root.

8. The turbine blade according to claim 7, wherein the overall web-to-channel ratio is larger than or equal to 0.3 and smaller than or equal to 0.6 at least at a span direction position of a groove base.

9. The turbine blade according to claim 7, the root comprising:

at least two grooves arranged on each lateral side, a bottom groove on each side being closest to the root base, wherein the overall web-to-channel ratio is larger than or equal to 0.3 and smaller than or equal to 0.6 at least at a span direction position of one of the bottom groove bases.

10. The turbine blade according to claim 7, the root comprising:

at least two grooves arranged on each lateral side, a bottom groove on each side being closest to the root base, wherein the overall web-to-channel ratio is larger than or equal to 0.3 and smaller than or equal to 0.6 at least at a span direction position of each of the bottom groove bases.

11. The turbine blade according to claim 7, wherein the overall web-to-channel ratio is larger than or equal to 0.3 and smaller than or equal to 0.6 at least essentially along an entire channel extent within the root, or within the load bearing section of the root, respectively.

12. The turbine blade according to claim 7, wherein at least one of the channels comprises:

an inlet fan section at the root base and a duct section, wherein the overall web-to-channel ratio is larger than or equal to 0.3 and smaller than or equal to 0.6 at least essentially along an entire duct extent within the root or within the load bearing section of the root, respectively.

13. A set of turbine blades according to claim 1, said set comprising:

at least two blades having airfoils of different airfoil lengths, wherein at least one of an overall web-to-channel ratio and/or a ratio between a web length and the length of the neighboring channels is larger for a blade with a larger airfoil length than for a blade with a smaller airfoil length.

14. A fir tree root for a blade, the fir tree root comprising:

a lengthwise direction, a crosswise direction extending between two lateral sides of the fir tree root, and a span direction extending from a root base, the fir tree root having at least one longitudinal groove arranged on each lateral side and extending along and defining the lengthwise direction, the fir tree root having a root width (w) measured between the two lateral sides, said root width (w)varying along the span direction, the fir tree root having at least two channels extending in the span direction, each of said channels having a channel length measured along the lengthwise direction, the root having a web interposed between each pair of neighboring channels, each web having a web length measured along the lengthwise direction, wherein for each web a local web-to-channel ratio between the web length and the channel length of each of the two neighboring channels is larger than or equal to 0.5 and is smaller than or equal to 0.85 at least at a position where the root width (w) is a minimum load bearing root width in a load bearing section of the fir tree root.

* * * * *